US005755523A

United States Patent [19]

Seydel

[11] Patent Number: 5,755,523

[45] Date of Patent: May 26, 1998

[54] SYSTEM AND METHOD FOR STORING AND DISPENSING TOOTHPASTE

[76] Inventor: Patricia R. Seydel, 460 Misty Rd., East Fallowfield, Pa. 19320

[21] Appl. No.: 690,346

[22] Filed: Jul. 26, 1996

[51] Int. Cl.[6] ..... A46B 11/02

[52] U.S. Cl. ..... 401/176; 401/178; 401/182

[58] Field of Search ..... 401/176, 178, 401/182

[56] References Cited

U.S. PATENT DOCUMENTS

| | | | |
|---|---|---|---|
| 1,114,646 | 10/1914 | Pap . | |
| 1,498,439 | 6/1924 | Flom . | |
| 2,278,253 | 3/1942 | Ellsworth | 401/176 |
| 2,547,287 | 4/1951 | Sanders et al. | 15/138 |
| 2,809,386 | 10/1957 | Asturias, Jr. | 401/176 X |
| 2,948,007 | 8/1960 | Tanguay | 15/137 |
| 3,256,894 | 6/1966 | Sherman | 132/84 |
| 3,378,176 | 4/1968 | Snyder | 222/389 |
| 4,135,831 | 1/1979 | Reitknecht | 401/175 |
| 4,199,270 | 4/1980 | Tomasini | 401/183 |
| 4,375,924 | 3/1983 | Lemire | 401/173 |
| 4,408,920 | 10/1983 | Walther et al. | 401/176 |
| 5,039,244 | 8/1991 | Cheng | 401/176 |
| 5,042,955 | 8/1991 | Moscatelli | 401/269 |
| 5,066,155 | 11/1991 | English et al. | 401/175 |
| 5,088,850 | 2/1992 | Taichman et al. | 401/176 |
| 5,096,321 | 3/1992 | Mountain | 401/149 |
| 5,425,590 | 6/1995 | Duaty et al. | 401/176 |

FOREIGN PATENT DOCUMENTS

| | | | |
|---|---|---|---|
| 1036068 | 4/1953 | France | 401/176 |
| 729378 | 12/1966 | Italy | 401/176 |

*Primary Examiner*—Steven A. Bratlie

[57] ABSTRACT

A method of storing and applying toothpaste to a toothbrush includes steps of connecting a threaded male end of a tube of toothpaste to a female end of a storage receptacle, forcing toothpaste from the tube of toothpaste into the storage receptacle, disconnecting the tube of toothpaste from the storage receptacle, connecting a male end of a brush member to the female end of the storage receptacle, and forcing toothpaste out of the storage receptacle and into the brush member, whereby the toothbrush is made ready to brush a consumer's teeth. A system for performing the improved method is also described.

5 Claims, 2 Drawing Sheets

SYSTEM AND METHOD FOR STORING AND DISPENSING TOOTHPASTE

BACKGROUND OF THE INVENTION

1. Field of the Invention

This invention relates generally to the field of oral hygiene, and more specifically to an improved system and process for storing and dispensing toothpaste on to a toothbrush.

2. Description of the Prior Art

Toothbrushes that have a supply of toothpaste contained therein, commonly known as "fountain-type" toothbrushes, have in general not been commercially successful, but have been the subject of several issued U.S. Patents. For example, U.S. Pat. No. 3,256,894 to Sherman discloses a dispensing-type toothbrush that has a cartridge of toothpaste contained in its handle, and a passage for guiding the toothpaste from the cartridge to the bristle area of the brush. Sherman uses a diaphragm arrangement to pneumatically urge the toothpaste out of the cartridge. This design would force consumers to purchase cartridges that are compatible with the system, and is not otherwise refillable from a standard tube of toothpaste.

More recently, fountain type toothbrushes that are refillable from a standard collapsible tube of toothpaste have been developed. U.S. Pat. No. 4,199,270 to Tomasini discloses a fountain toothbrush that has a handle member that is connected to a brush at its top end and has an open bottom end. An adapter is positioned in the bottom end for receiving an end of a tube of toothpaste for recharging the handle member. During brushing and storage, a plug is placed in the adapter member to keep toothpaste from escaping. Similarly, U.S. Pat. No. 5,096,321 discloses a fountain toothbrush that is rechargeable through an opening on the end of the handle that is opposite the toothbrush. While these systems solve the problem of compatibility with ordinary tubes of toothpaste that existed in Sherman, they are fairly complex, include a number of parts, and are expensive to make. Moreover, as any person who uses toothpaste can attest, toothpaste has a tendency to harden when it dries and can gum up and interfere with the operation of threaded components. A system such as that disclosed in Tomasini would require frequent cleaning of its three separate sets of thread couplings.

A need exists for an improved fountain type toothbrush that is compatible with ordinary collapsible tubes of toothpaste for recharging purposes, but that is less complex, less expensive to make and less annoying to use than systems that have to this point been known to the public.

SUMMARY OF THE INVENTION

Accordingly, it is an object of the invention to provide a design for an improved fountain type toothbrush that is compatible with ordinary collapsible tubes of toothpaste for recharging purposes, but that is less complex, less expensive to make and less annoying to use than systems that have to this point been known to the public.

In order to achieve the above and other objects of the invention, an improved method of storing and applying toothpaste to a toothbrush includes steps of (a) connecting threaded male end of a tube of toothpaste to a female end of a storage receptacle; (b) forcing toothpaste from the tube of toothpaste into the storage receptacle; (c) disconnecting the tube of toothpaste from the storage receptacle; (d) connecting a male end of a brush member to the female end of the storage receptacle; and (e) forcing toothpaste out of the storage receptacle and into the brush member, whereby the toothbrush is prepared to brush teeth.

According to a second aspect of the invention, an improved system for maintaining proper dental hygiene includes a storage receptacle having a storage chamber defined therein, structure for varying the volume of the storage chamber and an internally threaded female opening that is in communication with the storage chamber; and a brush member having a plurality of bristles, a male end having external threading thereon and a passage defined in the male end leading to the vicinity of the bristles, the male end and the external threading being sized and shaped to be screwable into the internally threaded female opening in the storage receptacle, whereby toothpaste from within the storage receptacle may be forced through the female opening and the passage to the vicinity of the bristles when the volume of the storage chamber is decreased; and wherein the internally threaded female opening is sized and shaped to receive a standard size and shape male threaded end of an ordinary tube of toothpaste for refilling the storage chamber.

According to a third aspect of the invention, a system for maintaining proper dental hygiene includes a tube of toothpaste having a male end that is externally threaded; a storage receptacle having a storage chamber defined therein, structure for varying the volume of the storage chamber and an internally threaded female opening that is in communication with the storage chamber; and a brush member having a plurality of bristles, a male end having external threading thereon and a passage defined in the male end leading to the vicinity of the bristles, the male end of the brush member and the external threading thereon being sized and shaped to be screwable into the internally threaded female opening in the storage receptacle, whereby toothpaste from within the storage receptacle may be forced through the female opening and the passage to the vicinity of the bristles when the volume of the storage chamber is decreased; and wherein the internally threaded female opening is also sized and shaped to receive the male end of the tube of toothpaste for refilling the storage chamber.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 2:
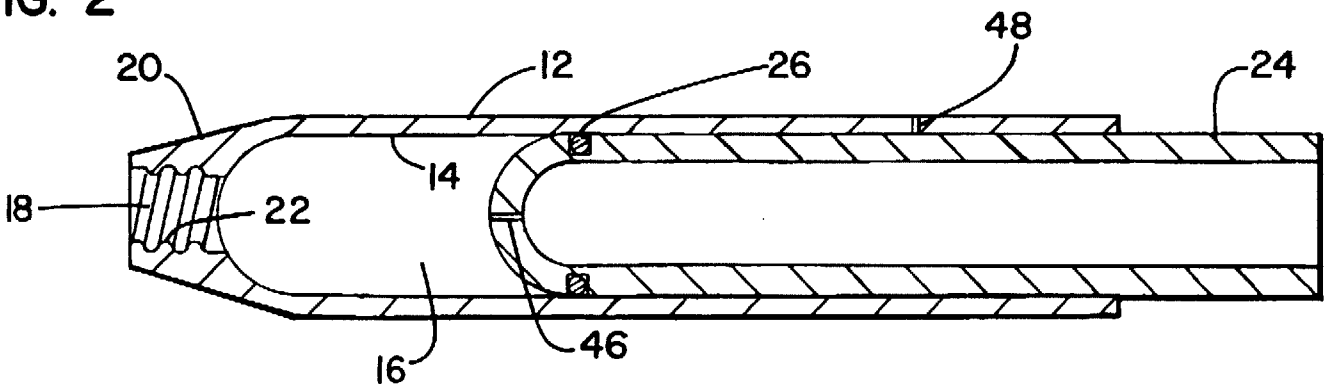
FIG. 2 is a longitudinal cross-sectional view taken thorough a storage receptacle that is also a part of the system of the preferred embodiment of the invention.
Figure 3A:
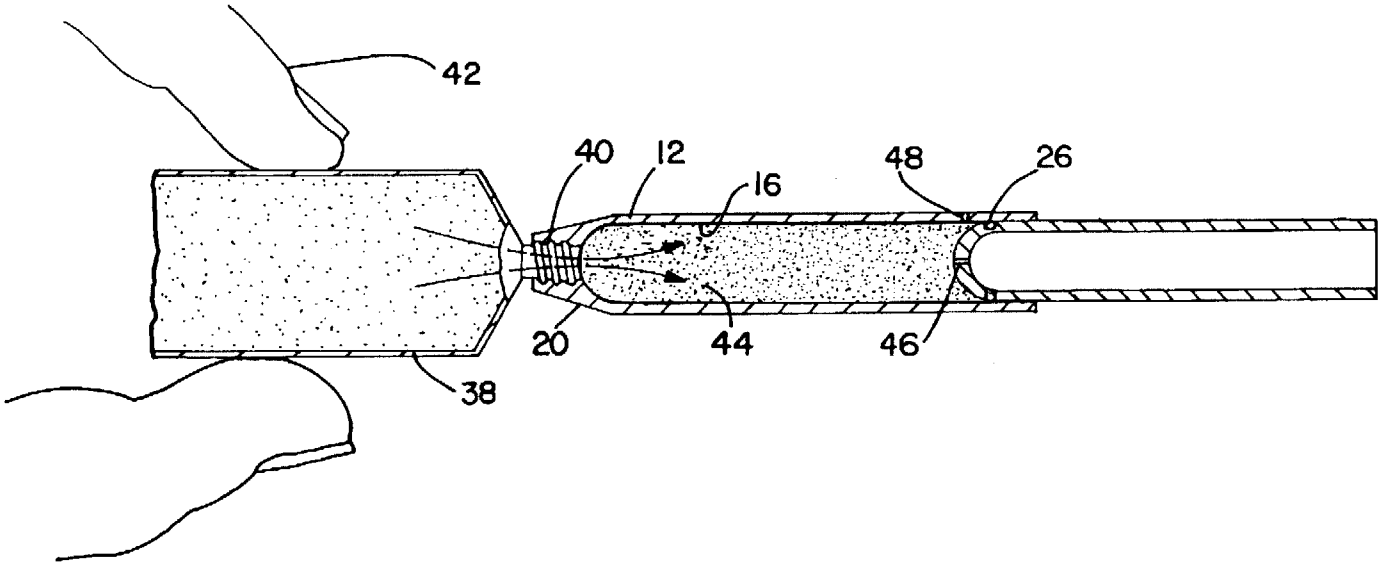
FIG. 3A depicts a system that is constructed according to the preferred embodiment of the invention being recharged with toothpaste from a conventional collapsible tube of toothpaste.
Figure 3B:
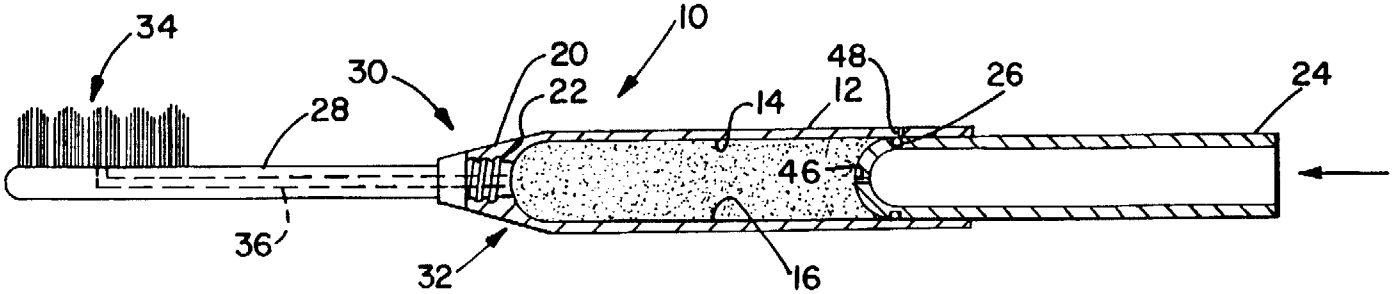
FIG. 3B depicts a system constructed according to a preferred embodiment of the invention that is charged with toothpaste and is ready for use.

Referring now to the drawings, wherein like reference numerals designate corresponding structure throughout the views, FIG. 3B depicts an assembled system 10 for maintaining proper dental hygiene that is constructed according to a preferred embodiment of the invention. As may best be seen in FIG. 2, the system 10 includes a storage receptacle 12 having a storage chamber 16 defined therein by an inner surface 14 of an outer wall of the storage receptacle 12. Storage receptacle 12 includes a first end that is tapered into a neck portion 20, with a female opening being provided in the first end that is given an internal threading 22. Internal threading 22 is constructed and arranged to be compatible with a threaded male end 40, shown in FIG. 3A, of a standard tube 38 of toothpaste, as well be described in greater detail below. Preferably, the internally threaded female opening 18 has an outer diameter of approximately 0.5 inches, and the threading 22 has a thread pitch of approximately 12 threads per inch.

Looking again to FIG. 2, it will be seen that storage receptacle 12 further includes structure for the varying the volume of the storage chamber 16, which is, in the preferred embodiment, a plunger member 24 that is movable into and out of the storage receptacle 12 and includes a seal 26, which is preferably an O-ring, for engaging the inner surface 14 of the wall of storage receptacle 12 that defines the storage chamber 16. Moving the plunger member 24 to the left, as it is shown in FIG. 2, will force toothpaste out of the female opening 18 of the storage receptacle 12, as may readily be envisioned and as will be discussed in greater detail below. As may be seen in FIG. 2, a small passage 46 is provided in plunger 24 to communicate storage chamber 16 with atmosphere. Passage 46 is sized so as to permit air, but not toothpaste, to flow easily therethrough.

Figure 1:
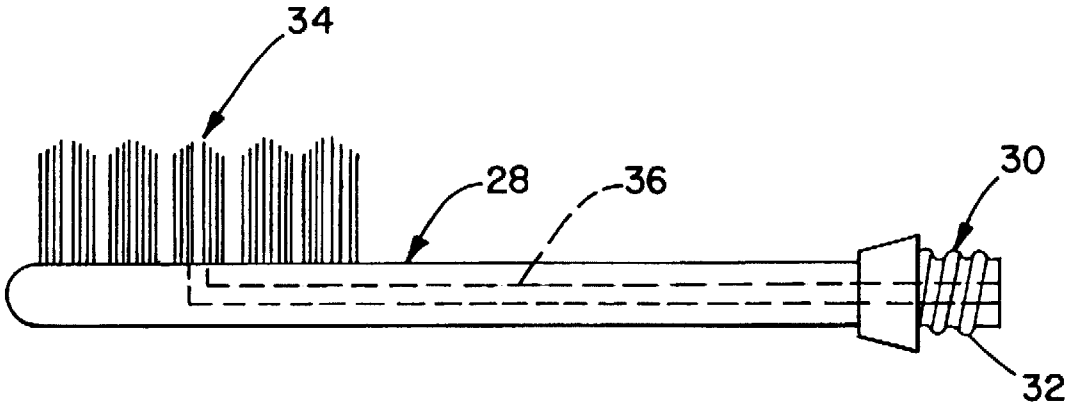
FIG. 1 is a side elevational view of a brush member that is part of the system of the preferred embodiment of the invention.

Looking now to FIG. 1, system 10 also includes a brush member 28 that has a plurality of bristles 34, a male end 30 that has external threading 32 thereon and a passage 36 that is defined in the male end 30 and that leads to the vicinity of the bristles 34, whereby any toothpaste forced into the male end 30 of the brush member 28 will be guided to the area of the bristles 34 during use. The external threading 32 on the male end 30 of brush member 28 is sized and shaped as to be screwable into the threading 22 that is provided in the female opening 18 of the storage receptacle 12, as is shown in the assembled system drawing that is provided in FIG. 3B.

In operation, a consumer starting with the disassembled system will first screw the threaded male end 40 of a tube 38 of toothpaste on to the female opening 18 of the storage receptacle 12, as is depicted in FIG. 3A. In FIG. 3A the user's hand is depicted by reference numeral 42. The user will then retract the plunger 24, moving it to the right as viewed in FIG. 3A. As this occurs, air will be permitted to move into the expanding volume of chamber 16 through the passage 46, making retraction of the plunger easier. The user will then squeeze the collapsible tube 38 of toothpaste in order to force the toothpaste 44 into the storage chamber 16 of the storage receptacle 12. As this occurs, air will be displaced from chamber 16 through passage 46 and through another passage 48 that is defined in the wall of the receptacle 12 just forward of the farthest anticipated retraction of the plunger. The user or consumer will than disconnect the tube 38 of toothpaste from the storage receptacle 12 by unscrewing it, and will then screw the threaded male end 30 of the brush member 28 into the same threaded female opening 18 of the storage receptacle 12 that the tube 38 of toothpaste was previously connected to. After this is completed, the user can force toothpaste out of the storage chamber 16, and through the passage 36 and the brush member 28 to the vicinity of the bristles 34 by moving the plunger member 24 to the left, as this is shown in FIG. 3B, in order to initiate brushing.

Because the same threaded opening 18 is used for both recharging the system and for mounting the brush member 28 to the storage receptacle 12, the system 10 is considerably less complex than fountain type toothbrushes heretofore known. In addition, the inventive toothbrush system has fewer relatively moving parts that can be gummed up by toothpaste during operation. As a result a system 10 according to the invention is more likely to be accepted than fountain type toothbrush designs that have previously been advanced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A toothbrush with integral toothpaste dispenser comprising:

a. a brush member comprising;
  (1). an elongated support member;
  (2). bristles;
  (3). a male end having external threading thereon; and
  (4). a passage defined from the male end leading to the vicinity of the bristles;

b. a hollow substantially cylindrical outer storage receptacle having one end tapered into a neck portion and the opposite end open;
  (1). the inside surface of the outer storage receptacle at the tapered end having a hemispherical shape;
  (2). the tapered neck portion of the outer storage receptacle having an internally threaded female opening communicating with the interior of the storage receptacle wherein the threading matches the male threading on the brush member; and
  (3). a ventilation passage through the wall of the storage receptacle substantially near the open end of the storage receptacle; and c. a hollow cylindrical plunger member having an outside diameter which slidably engages the hollow cylindrical outer receptacle, a first end which has a hemispherical shape, and a second end of which has a flat shape;
  (1). a ventilation passage through the hemispherical wall of the plunger member communicating with the interior of the plunger member; and
  (2). a seal on the outer surface of the plunger at the base of the hemispherical end comprising;
    (a). a grove encircling the plunger; and
    (b). an O ring which extends sufficiently out of the grove to engage the inner surface of the storage receptacle.

2. The toothbrush of claim 1 in which:

a. the diameter of the female opening and the pitch of the internal threads in the female opening correspond to the standardized diameter and pitch used in the male end of a commercial toothpaste tube; and b. the diameter of the male end of the brush member and the pitch of the external threads on the male end of the brush member correspond to the standardized diameter and pitch used in the male end of a commercial toothpaste tube.

3. A portable system for maintaining proper dental hygiene comprising:

a. a brush member comprising;

(1). an elongated support member;

(2). bristles;

(3). a male end having external threading thereon; and (4). a passage defined from the male end leading to the vicinity of the bristles;

b. a hollow substantially cylindrical outer storage receptacle having one end tapered into a neck portion and the opposite end open;

(1). the inside surface of the outer storage receptacle at the tapered end having a hemispherical shape;

(2). the tapered neck portion of the outer storage receptacle having an internally threaded female opening communicating with the interior of the storage receptacle wherein the threading matches the male threading on the brush member; and (3). a ventilation passage through the wall of the storage receptacle substantially near the open end of the storage receptacle; and c. a hollow cylindrical plunger member having an outside diameter which slidably engages the hollow cylindrical outer receptacle, a first end which has a hemispherical shape, and a second end of which has a flat shape;

(1). a ventilation passage through the hemispherical wall of the plunger member communicating with the interior of the plunger member; and (2). a seal on the outer surface of the plunger at the base of the hemispherical end comprising;

(a). a grove encircling the plunger; and (b). an O ring which extends sufficiently out of the grove to engage the inner surface of the storage receptacle wherein the system may be precharged with toothpaste from a standard toothpaste tube and, when desired, toothpaste may be forced, by means of depressing the plunger, through the female opening into the passage and thence to the vicinity of the bristles.

4. The system of claim 3 in which:

a. the diameter of the female opening and the pitch of the internal threads in the female opening correspond to the standardized diameter and pitch used in the male end of a commercial toothpaste tube; and b. the diameter of the male end of the brush member and the pitch of the external threads on the male end of the brush member correspond to the standardized diameter and pitch used in the male end of a commercial toothpaste tube.

5. A method of storing and applying toothpaste to a toothbrush, comprising the steps of:

a. withdrawing a hollow cylindrical plunger having one hemispherical end, an outside diameter sized to permit slidable engagement with the inner surface of an outer storage receptacle, and a seal substantially all the way out of an outer storage receptacle which has a tapered end and an open end;

b. screwing the threaded male end of a tube of toothpaste into the tapered female end of the storage receptacle;

c. forcing toothpaste from the tube of toothpaste into the space within the storage receptacle between the tapered end of the receptacle and the hemispherical end of the plunger, wherein the air inside the storage receptacle is displaced from the storage receptacle through passages in the side wall of the storage receptacle and the hemispherical end of the plunger;

d. unscrewing the tube of toothpaste from the tapered female end of the storage receptacle;

e. screwing a male end of a brush member into the tapered female end of the storage receptacle; and f. moving the plunger to reduce the volume of the space between the tapered end of the receptacle and the hemispherical end of the plunger wherein toothpaste is forced out of the storage receptacle into the brush member preparing the toothbrush with toothpaste to brush teeth.

* * * * *